US009980587B2

(12) United States Patent
Miller et al.

(10) Patent No.: US 9,980,587 B2
(45) Date of Patent: May 29, 2018

(54) NON-GUSSET PILLOW

(71) Applicant: Hollander Sleep Products, LLC, Boca Raton, FL (US)

(72) Inventors: Tracy Laskowski Miller, Naperville, IL (US); Brandon Palmer, Chicago, IL (US)

(73) Assignee: Hollander Sleep Products, LLC, Boca Raton, FL (US)

( * ) Notice: Subject to any disclaimer, the term of this patent is extended or adjusted under 35 U.S.C. 154(b) by 188 days.

(21) Appl. No.: 14/666,047

(22) Filed: Mar. 23, 2015

(65) Prior Publication Data

US 2015/0265076 A1 Sep. 24, 2015

Related U.S. Application Data

(60) Provisional application No. 61/968,758, filed on Mar. 21, 2014.

(51) Int. Cl.
*A47G 9/10* (2006.01)
*A47G 9/02* (2006.01)

(52) U.S. Cl.
CPC ..... *A47G 9/10* (2013.01); *A47G 9/0253* (2013.01)

(58) Field of Classification Search
CPC ..... A47G 2009/1018; A47G 9/10; A47G 9/1027; A47G 9/0253; A61G 13/121; A61G 7/072
USPC ..... 5/682
See application file for complete search history.

(56) References Cited

U.S. PATENT DOCUMENTS 2,298,218 A * 10/1942 Madson ..... A47C 27/14 5/638
3,109,182 A 11/1963 Doak
3,283,343 A * 11/1966 Worcester ..... A47C 27/081 5/249
3,462,775 A * 8/1969 Bernhard ..... A61F 5/01 128/889
4,090,269 A * 5/1978 Hunt ..... A47G 9/086 2/69.5
4,115,610 A * 9/1978 Wortman ..... A47G 9/0207 112/420
4,137,111 A * 1/1979 Hansen ..... A47G 9/0207 156/291
4,167,795 A * 9/1979 Lambert, Jr. ..... A47C 27/085 428/182
5,729,851 A 3/1998 Hollander
5,758,375 A * 6/1998 Horowitz ..... A47G 9/10 5/640
6,760,935 B1 7/2004 Burton et al.
7,074,242 B2 7/2006 Palmer et al.
2005/0217029 A1* 10/2005 Funatogawa ..... A47G 9/10 5/645

(Continued)

*Primary Examiner* — Eric J Kurilla
(74) *Attorney, Agent, or Firm* — Lerner, David, Littenberg, Krumholz & Mentlik, LLP

(57) ABSTRACT

A pillow is provided, including a first longer fabric panel extending to a first length-wise edge of a first shorter fabric panel and folded over a first fold line and extending to a first length-wise edge of a second shorter fabric panel; and a second longer fabric panel extending to a second length-wise edge of the second shorter fabric panel and folded over a second fold line and extending to a second length-wise edge of a first shorter fabric panel, the first longer fabric panel and the second longer fabric panel being different lengths.

6 Claims, 23 Drawing Sheets

(56) References Cited

U.S. PATENT DOCUMENTS

| | | | | |
|---|---|---|---|---|
| 2005/0262637 | A1* | 12/2005 | Funatogawa | A47G 9/10 5/636 |
| 2013/0312194 | A1* | 11/2013 | Sullivan | A47G 9/1027 5/644 |
| 2013/0344278 | A1* | 12/2013 | Horst | A47C 27/002 428/74 |
| 2015/0265077 | A1* | 9/2015 | Miller | A47G 9/10 5/645 |

* cited by examiner

Perspective View

Exploded View

NON-GUSSET PILLOW

PRIORITY

This application claims priority under 35 U.S.C. § 119 to a provisional application filed in the United States Patent and Trademark Office on Mar. 21, 2014, and assigned Ser. No. 61/968,758, the entire disclosure of which is incorporated herein by reference.

FIELD OF THE INVENTION

The present invention relates to non-gusset pillows and, more particularly, to pillows that do not include an additional piece of fabric that extends between the top and bottom surfaces of the pillow at the pillow's edge.

BACKGROUND

Pillows come in many shapes and sizes. A traditional or ordinary pillow has a simple construction, with top and bottom pieces of fabric sewn together along their edges filled with an appropriate filling material (i.e., the "fill"). Ordinary pillows share a variety of problems, including a tendency for the fill within the pillows to move away from the pillows' edges, which in turn results in lower neck support or other undesired characteristics. Gusseted pillows have been designed to address some of the shortcomings of ordinary pillows. In particular, gusseted pillows include a piece of material (i.e., the "gusset") that extends between the peripheral edges of the pillow between the top and bottom portions/surfaces of the pillow. Gusseted pillows usually have a high loft as compared to non-gusset (or non-gusseted) pillows. Examples of gusseted pillows are disclosed in U.S. Pat. No. 3,109,182, U.S. Pat. No. 5,729,851, and U.S. Pat. No. 6,760,935, which are incorporated herein by reference. As shown in each of these patents, the pillows include a gusset around the pillow's periphery and disposed between the pillow's top and bottom surfaces.

But gusseted pillows have their own shortcomings depending on the needs of users and, thus, are not satisfactory under various circumstances. Accordingly, there still is a need for yet further pillow constructions that provide advantageous characteristics.

SUMMARY

According to an aspect of the present invention, a pillow is provided, including a first longer fabric panel extending to a first length-wise edge of a first shorter fabric panel and folded over a first fold line and extending to a first length-wise edge of a second shorter fabric panel; and a second longer fabric panel extending to a second length-wise edge of the second shorter fabric panel and folded over a second fold line and extending to a second length-wise edge of a first shorter fabric panel, the first longer fabric panel and the second longer fabric panel being different lengths.

According to another aspect of the present invention, a pillow is provided, including a first longer fabric panel extending to a first length-wise edge of a first shorter fabric panel and extending to a first length-wise edge of a second shorter fabric panel; and a second longer fabric panel extending to a second length-wise edge of the second shorter fabric panel and folded over a first fold line, a second fold line and extending to a second length-wise edge of a first shorter fabric panel, the first longer fabric panel and the second longer fabric panel being different lengths.

According to yet another aspect of the present invention, a pillow is provided, including a first panel coupled to a second panel; and a baffle coupled to the first panel and the second panel, forming a first chamber and a second chamber, the first chamber filled with a first fill, the second chamber filled with a second fill, and the baffle being angled.

DETAILED DESCRIPTION OF THE PRESENT INVENTION

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PRESENT INVENTION

Figure 1A:
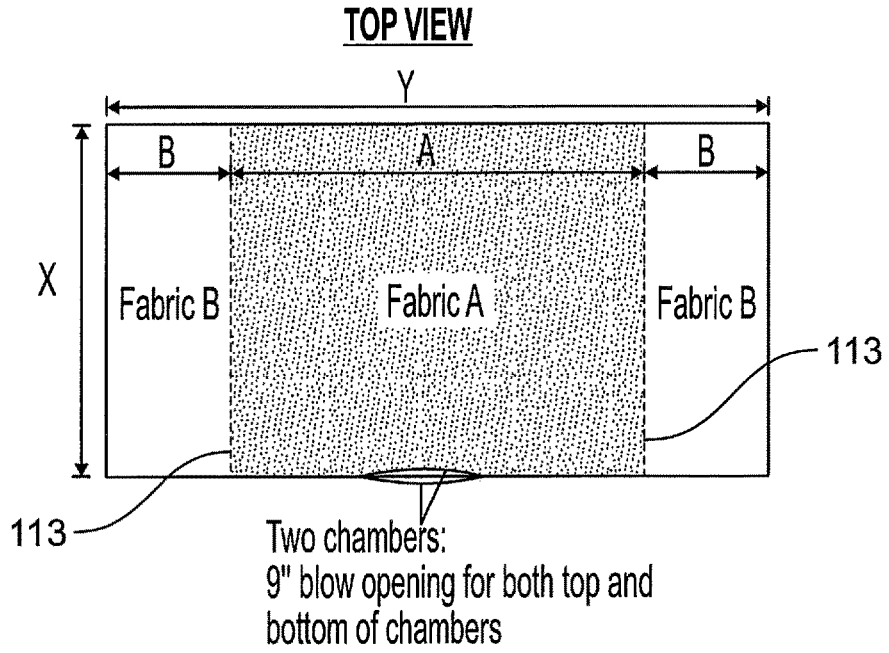
FIG. 1A is a schematic illustration of a top view of a non-gusset pillow according to a first embodiment of the present invention.

As described herein, each of the embodiments disclosed in the drawings and described in this Detailed Description section employ various pieces of fabric of various shapes and sizes, sewn or otherwise attached together that, when filled with an appropriate filling material, create a pillow. The filling material may be cotton, polyester, feathers, down, a combination of feathers and down, filling known as Lyocell Down as described in U.S. Pat. No. 7,074,242, other appropriate filling material, or any combination thereof. The particular material used to construct the various pieces of fabric may include cotton, polyester, polyblend or other suitable material or combinations of materials. Accordingly, the pillows of embodiments of the present invention as described herein are not to be limited to any particular type of filling material or type of material used to construct the various sections, compartments, baffles, etc.

Figure 1B:
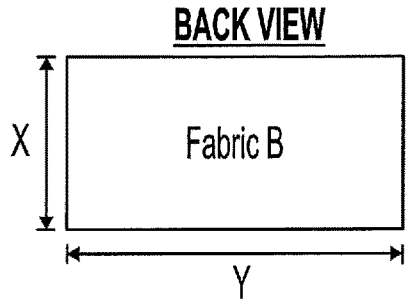
FIG. 1B is a schematic illustration of a back view of a non-gusset pillow according to a first embodiment of the present invention.
Figure 1C:
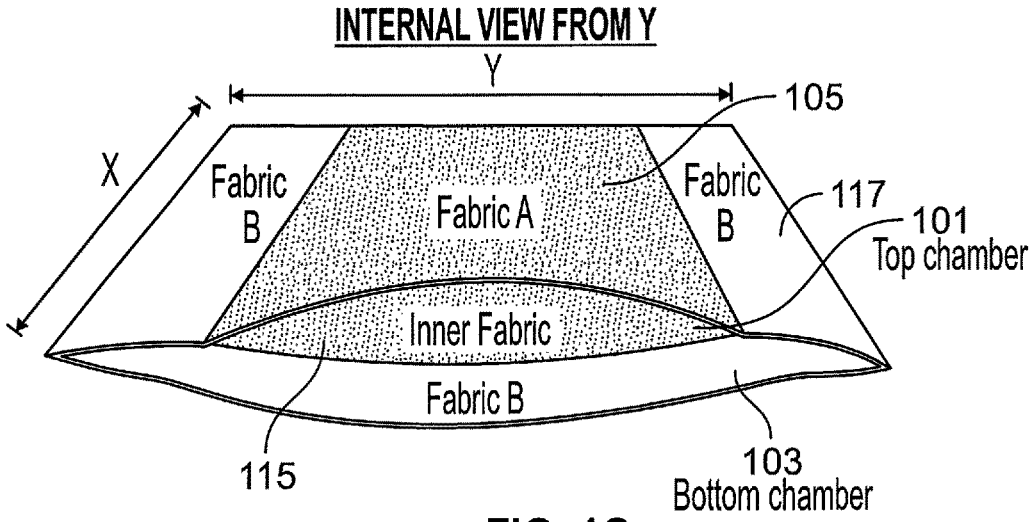
FIG. 1C is a schematic illustration of an internal view of a non-gusset pillow according to a first embodiment of the present invention.
Figure 1D:
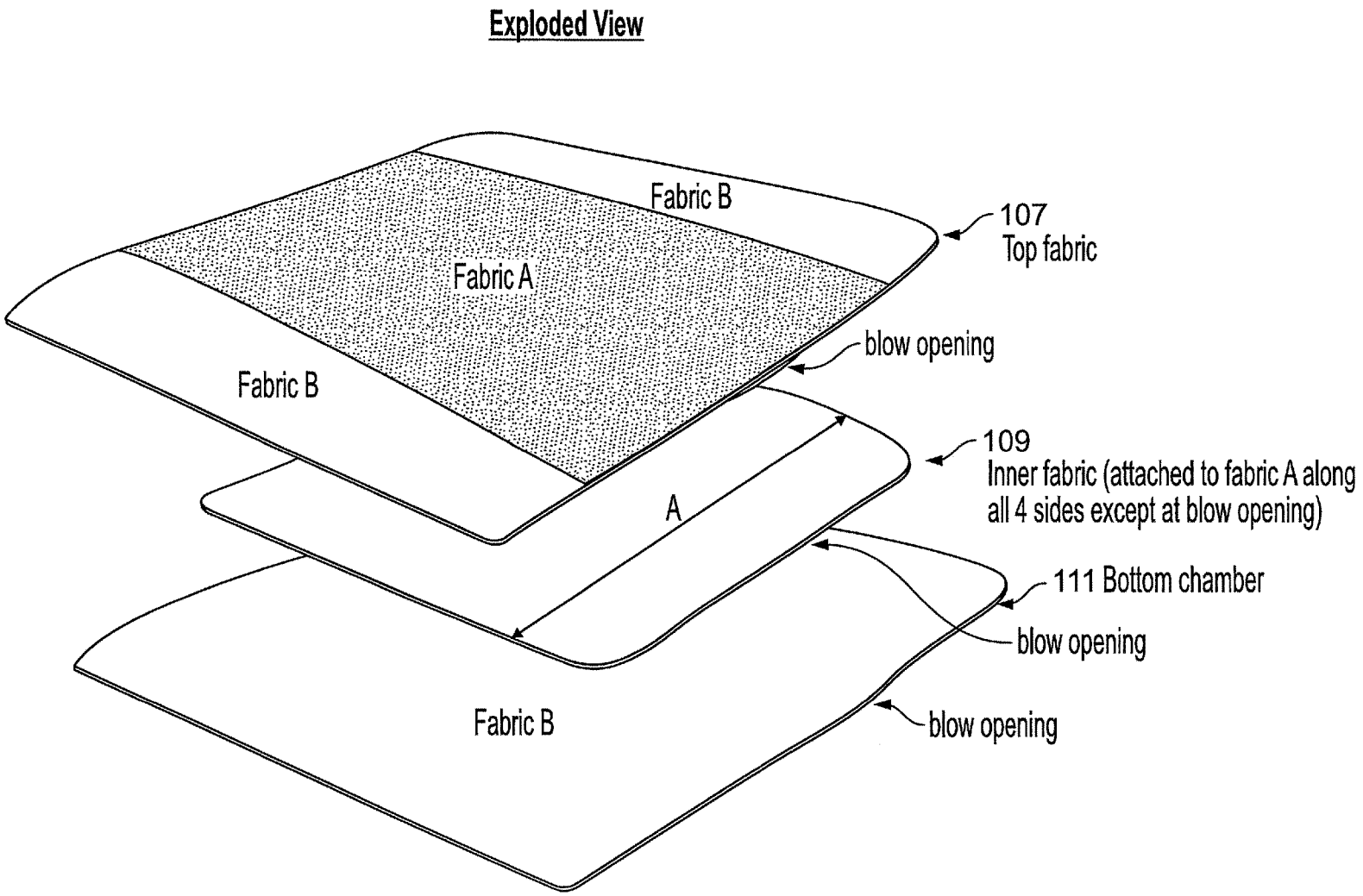
FIG. 1D is a schematic illustration of an exploded view of a non-gusset pillow according to a first embodiment of the present invention
Figure 1E:
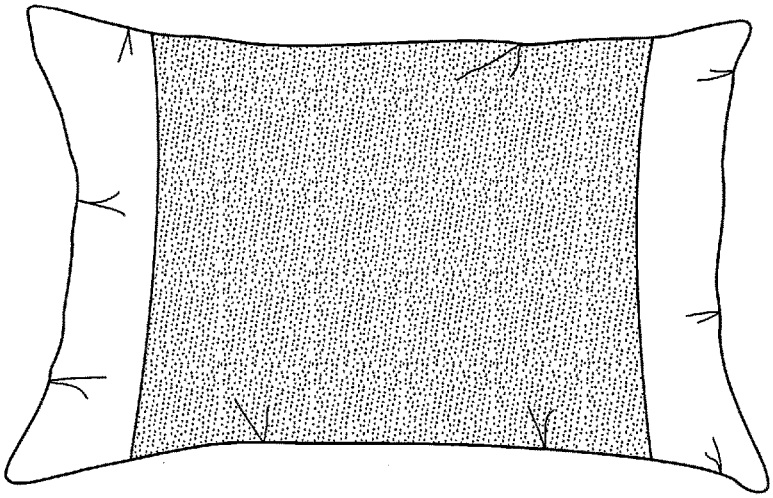
FIGS. 1E and 1F are photographs of two sides of a non-gusset pillow according to a first embodiment of the present invention.
Figure 1F:
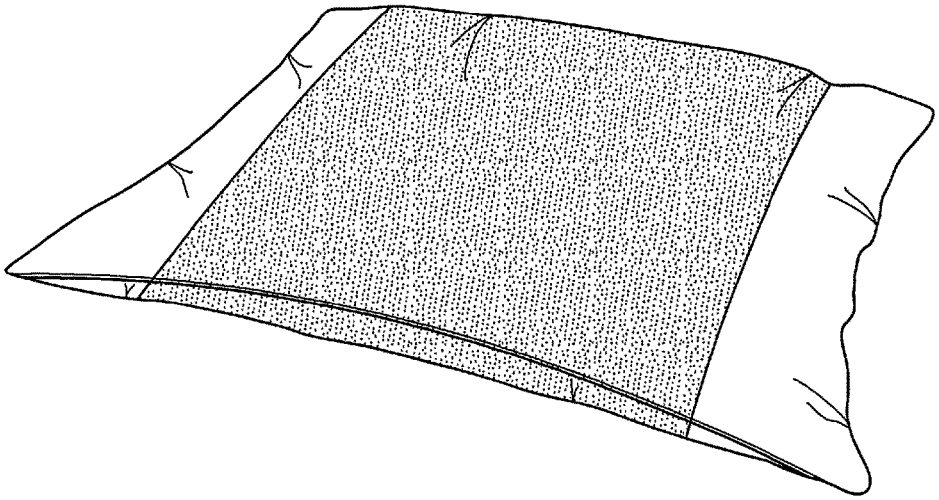

Referring now to the drawings, and particularly to FIGS. 1A through 1F thereof, there is shown a non-gusset pillow in accordance with a first embodiment of the present invention. The non-gusset pillow shown in FIGS. 1A through 1D is a two-chamber pillow with an inner panel. FIG. 1A shows a top view of the two-chamber pillow; FIG. 1B shows a back view; FIG. 1C shows an internal view; and FIG. 1D shows an exploded view. FIGS. 1E and 1F are photographs of an exemplary two-chamber pillow in accordance with this first embodiment.

As best shown in the internal view of FIG. 1C, the pillow in accordance with this first embodiment includes top chamber 101 and bottom chamber 103, in which the top chamber 101 is disposed between fabric A 105 of the top panel 107 (top fabric) and an inner fabric panel 109 (inner fabric). As shown in FIG. 1D, fabric A 105 represents a sub-portion, that is, not the entire portion, of the top panel 107 of the pillow. Referring back to FIG. 1C, the bottom chamber 103 is defined by and disposed between the inner fabric panel 109 and two sections—shown as fabric B 117—of the top panel 107, which collectively define the top surface of the bottom chamber, and the bottom panel (shown as bottom fabric panel 11 in FIG. 1D) which defines the bottom of pillow (i.e., lower fabric B shown in FIG. 1C).

Figure 10:
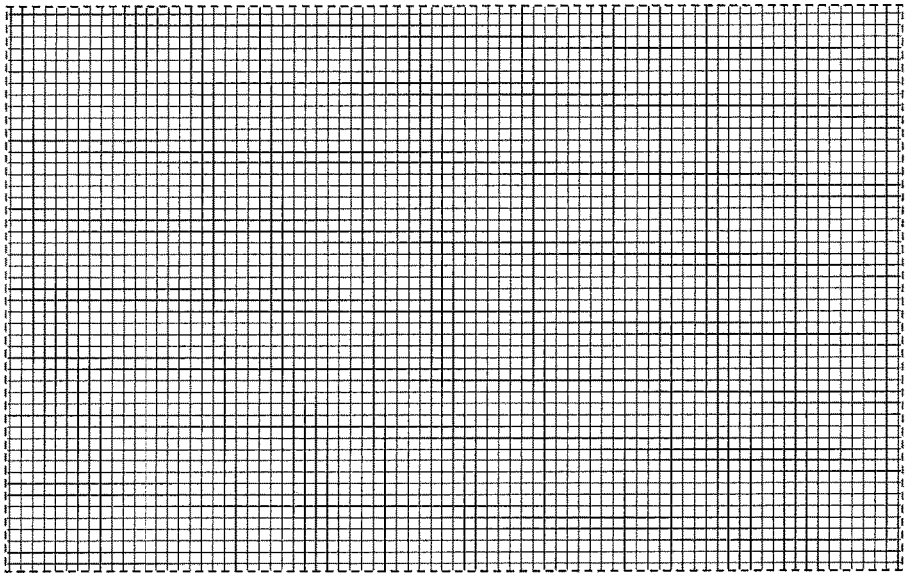
FIG. 10 is a photograph of the top fabric of a pillow, according to an embodiment of the present invention.

In one version, fabric A and fabric B are different materials. In one example of this version, fabric A is 63% polyester/37% lyocell circular knit fabric, with a weight of 240 g, and a pattern such as shown in FIG. 10, and fabric B is 330 tc, 100% Cotton, Twill, SPI 173×156/60×60. In addition, the inner fabric panel, shown in FIGS. 1C and 1D, may be 230 tc, 100% polyester, 1×1 plainweave, 144×86/65 D×65 D, and in which the exemplary dimensions of the pillow are defined as A=18 inches (") and B=4" (dimensions A and B shown in FIG. 1A), and the outer pillow dimensions are X=20" and Y=26" (dimensions X and Y shown in FIGS. 1B and 1C).

FIGS. 1E and 1F are photographs of exemplary pillows in accordance with such a version of this first embodiment of the present invention. As clearly shown in FIGS. 1E and 1F, as well as in the schematic illustration of FIGS. 1A and 1C, two of the seam lines 113 of the top chamber are not disposed at the end of the pillow, but instead, are disposed at a distance away from the edges. In the exemplary pillow identified above, and shown in FIGS. 1E and 1F, the two seam lines of the top chamber are disposed 4" (B=4") away the outer edges of the pillow. Further, as shown in FIGS. 1E and 1F, the pillow has a relatively high loft due its constructions.

Moreover, as best shown in FIG. 1C, the pillow of this first embodiment is comprised of three types of fabric, that is, fabric A 105, fabric B 117, and an inner fabric 115, in which fabric B 117 extends partially along the top of the pillow, then along the entire length of the bottom of the pillow, and then again partially along the top of the pillow (at the other end). Fabric A 105 extends only along a partial length, but not the entire length, of the top of the pillow, and specifically does not extend to either the left side or the right side of the pillow (using the orientation of the pillow shown in FIG. 1C). The inner fabric likewise extends only partially along the width of the pillow and has a length (i.e., width) that is the same as or substantially the same as the length of fabric A 105, and in which the inner fabric is sewn or otherwise coupled along the edges of fabric A 105, as shown in FIG. 1C.

Fabric B 117 may be a single piece of fabric or may be comprised of multiple pieces of fabric. In FIG. 1D, the pillow is shown to include three distinct panels, the top panel that is comprised of a section of fabric A 105 and two sections of fabric B 117, a middle panel (shown as the inner fabric), and the lower panel that is comprised solely of fabric B 117. As shown in FIG. 1C, the inner panel has a shape and size that is the same as the fabric A 105 portion of the top panel (107 of FIG. 1D).

In a different version, all of the fabric B 117 sections are part of a single panel in which such single panel extends initially along a part of the top of the pillow, then folded (as described in various other embodiments), then extends along the entire bottom of the pillow, then folded again, and then extends partially along a part of the top of the pillow, such as best shown in FIG. 1C.

In addition, other types of materials and dimension may be employed than that described above. In yet another version of this first embodiment, fabric A 105 and fabric B 17 are made from the same type of material.

Figure 2A:
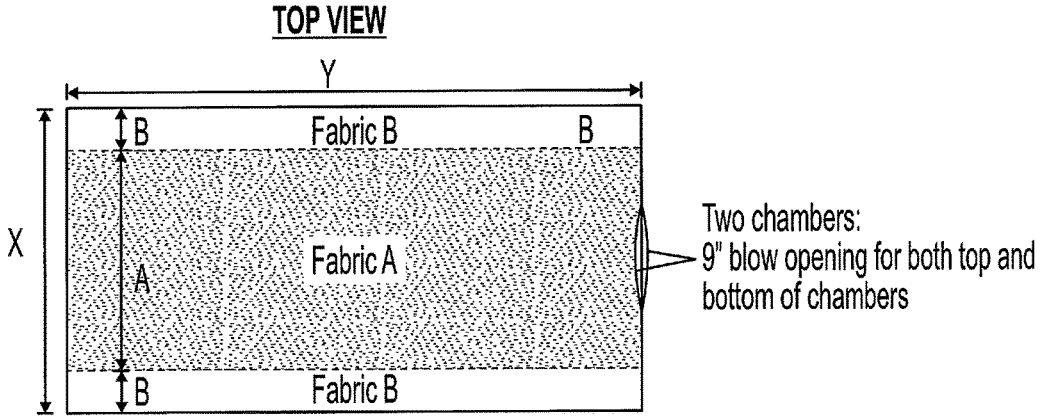
FIG. 2A is a schematic illustration of a top view of a non-gusset pillow according to a second embodiment of the present invention.
Figure 2B:
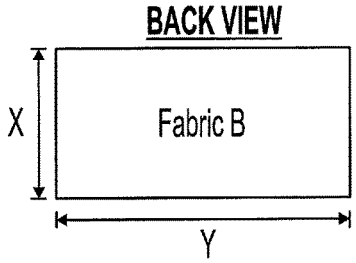
FIG. 2B is a schematic illustration of a back (or bottom) view of a non-gusset pillow according to a second embodiment of the present invention.
Figure 2C:
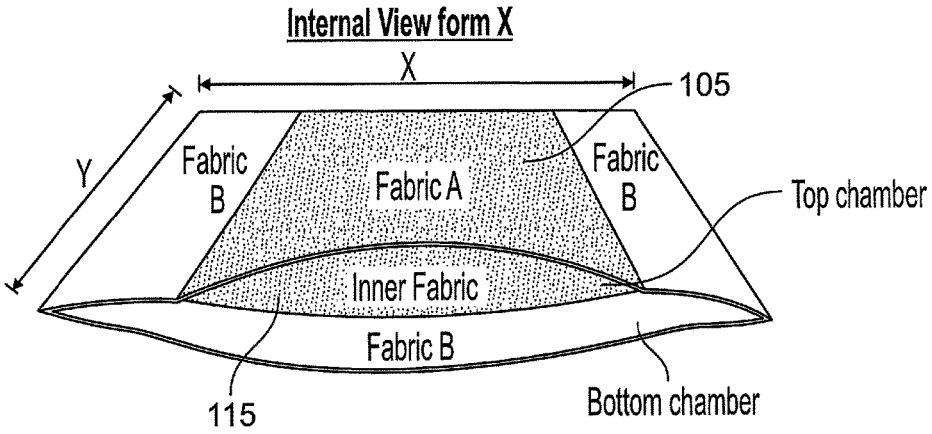
FIG. 2C is a schematic illustration of an internal view of a non-gusset pillow according to a second embodiment of the present invention
Figure 2D:
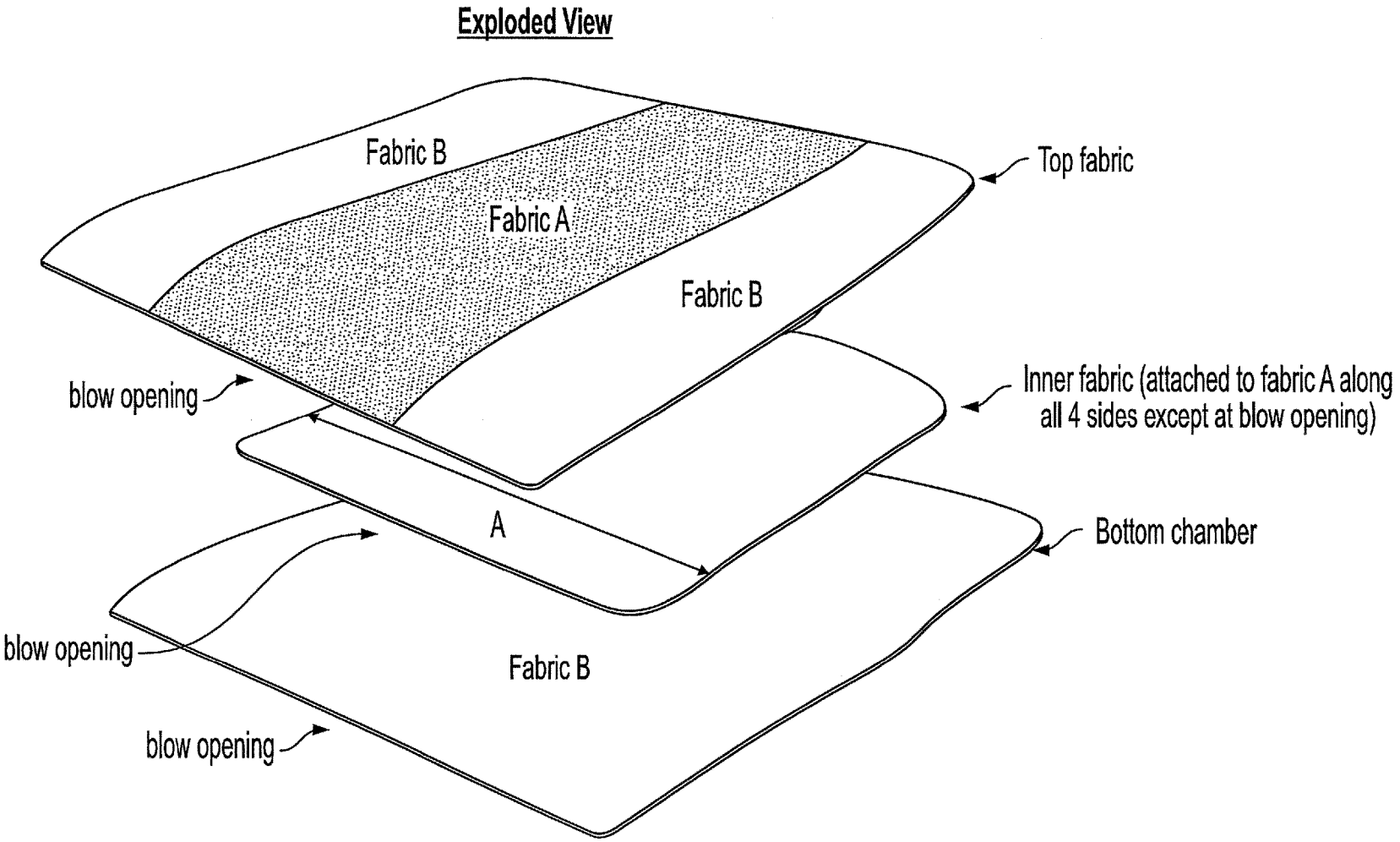
FIG. 2D is a schematic illustration of an exploded view of a non-gusset pillow according to a second embodiment of the present invention.

FIGS. 2A-2D show a non-gusset pillow in accordance with a second embodiment of the present invention. FIG. 2A shows a top view; FIG. 2B shows a back (or bottom) view; FIG. 2C shows an internal view; and FIG. 2D shows an exploded view. The pillow in accordance with this second embodiment is highly similar to the first embodiment described above, but in the second embodiment, the top chamber extends along the entire width of the pillow, but does not extend along the entire length of the pillow, such as shown in FIG. 2A, whereas in the first embodiment it is reversed, that is, in the first embodiment, the top chamber extends along the entire length of the pillow, but does not extend along the entire width of the pillow, such as shown in FIG. 1A.

Figure 2E:
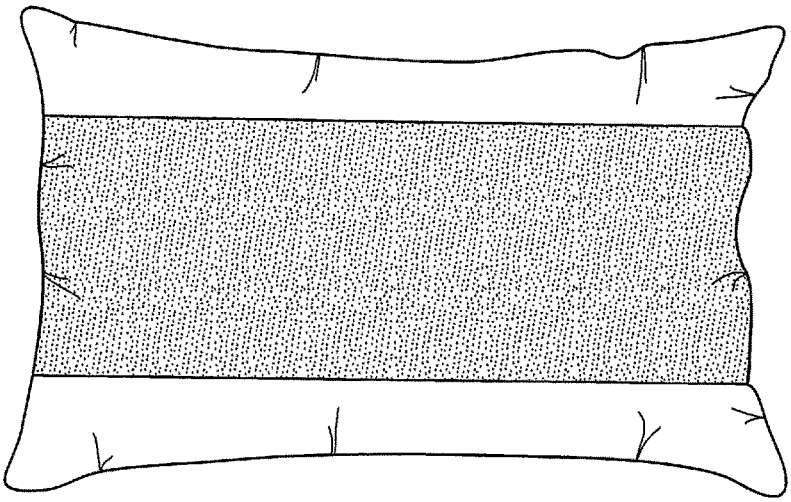
FIGS. 2E and 2F are photographs of two sides of a non-gusset pillow according to a second embodiment of the present invention.
Figure 2F:
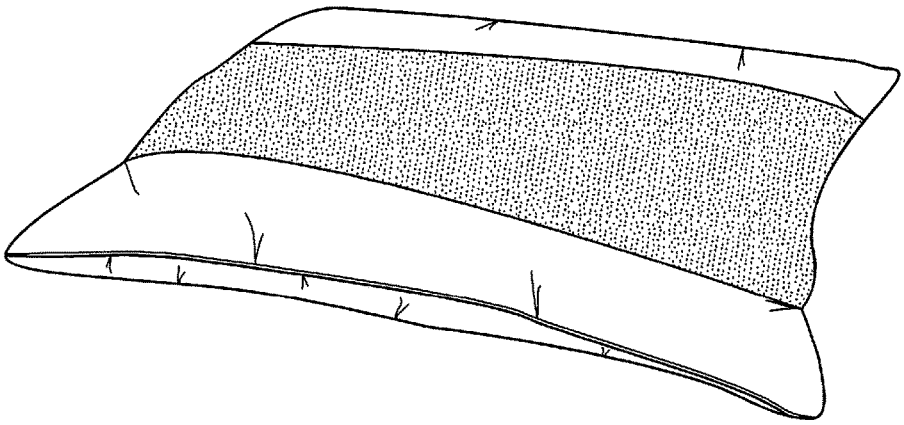

FIGS. 2E and 2F are photographs of an exemplary pillow in accordance with the second embodiment.

Using the exemplary dimensions given above in connection with the first embodiment in this second embodiment, with X=20" and Y=26" (see FIGS. 2A, 2C), the top chamber extends only partially along one dimension, having an exemplary width of A=10" (see FIG. 2A) and B=5". Of course, other suitable dimensions and lengths may be employed, but where the entire top chamber does not extend fully across the width of the pillow.

Similar to the first embodiment, the dimensions and materials of the pillow in accordance with the second embodiment may differ than that described above.

Figure 3A:
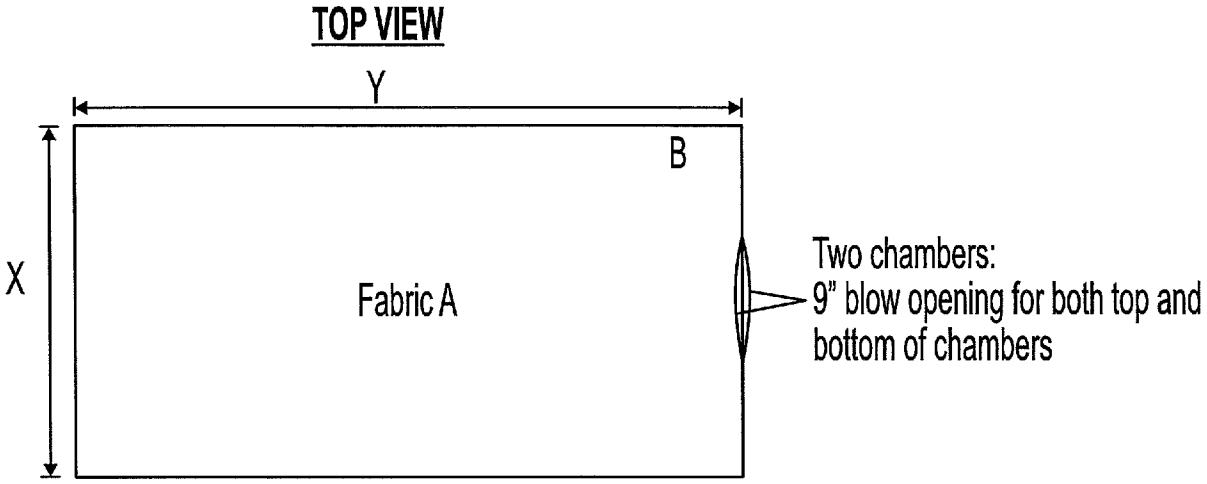
FIG. 3A is a schematic illustration of a top view of a non-gusset pillow according to a third embodiment of the present invention.
Figure 3B:
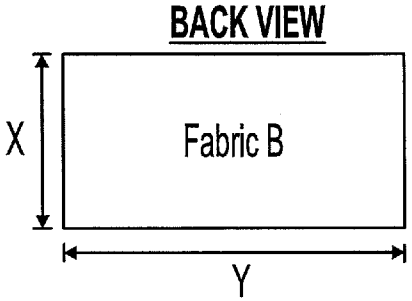
FIG. 3B is a schematic illustration of a back view of a non-gusset pillow according to a third embodiment of the present invention.
Figure 3C:
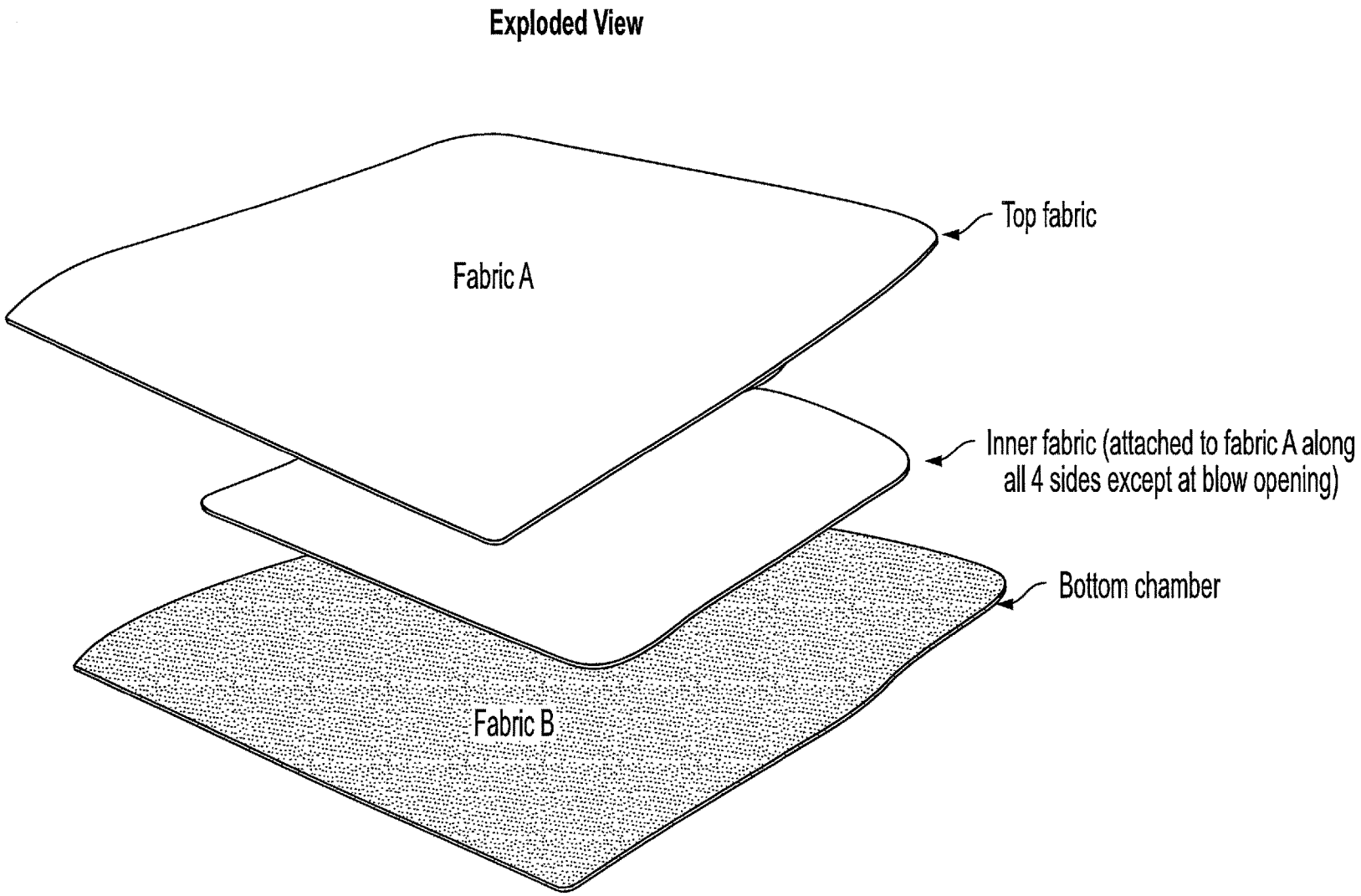
FIG. 3C is a schematic illustration of an exploded view of a non-gusset pillow according to a third embodiment of the present invention.

FIGS. 3A through 3C show a pillow with an interior baffle in accordance with a third embodiment of the present invention. FIG. 3A is a top view; FIG. 3B is a back view; and FIG. 3C is an exploded view.

Figure 3D:
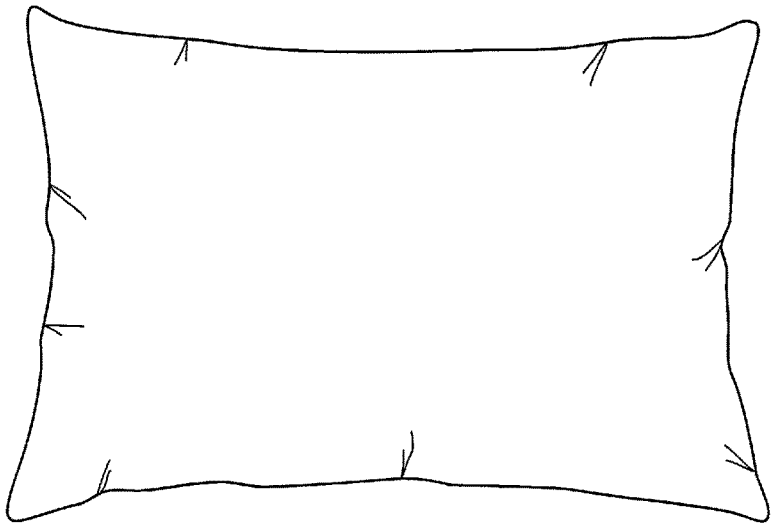
FIGS. 3D and 3E are photographs of two sides of a non-gusset pillow according to a third embodiment of the present invention.
Figure 3E:
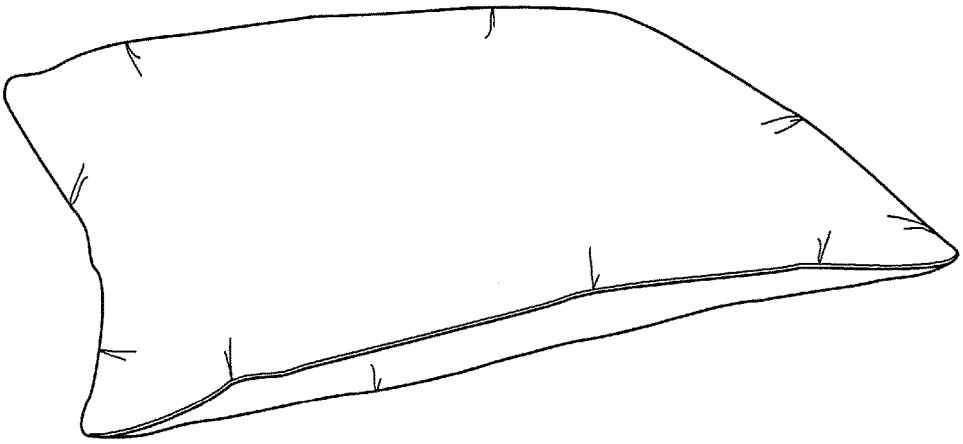

As shown in FIG. 3C, the three panels of the pillow have the same or nearly the same dimensions and are sewn together along their periphery to form the pillow shell. In this third embodiment, the central panel extends from end to end, that is, along the entire footprint of the pillow. The various features and variations of the first two embodiments also are applicable to this third embodiment. FIGS. 3D and 3E are photographs of exemplary pillows in accordance with the third embodiment of the present invention.

Figure 4A:
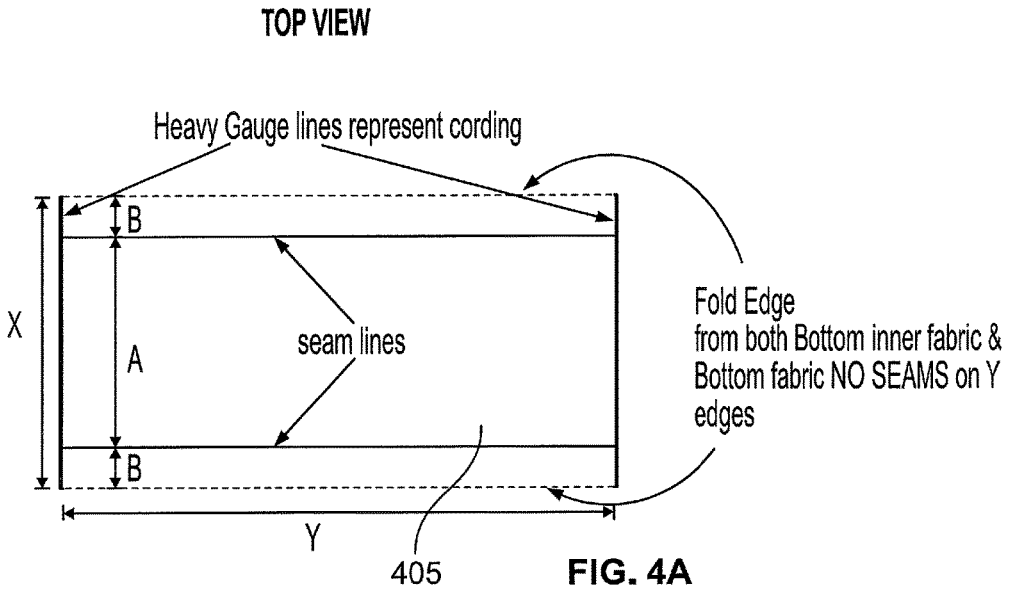
FIG. 4A is a schematic illustration of a top view of a non-gusset pillow according to a fourth embodiment of the present invention.
Figure 4B:
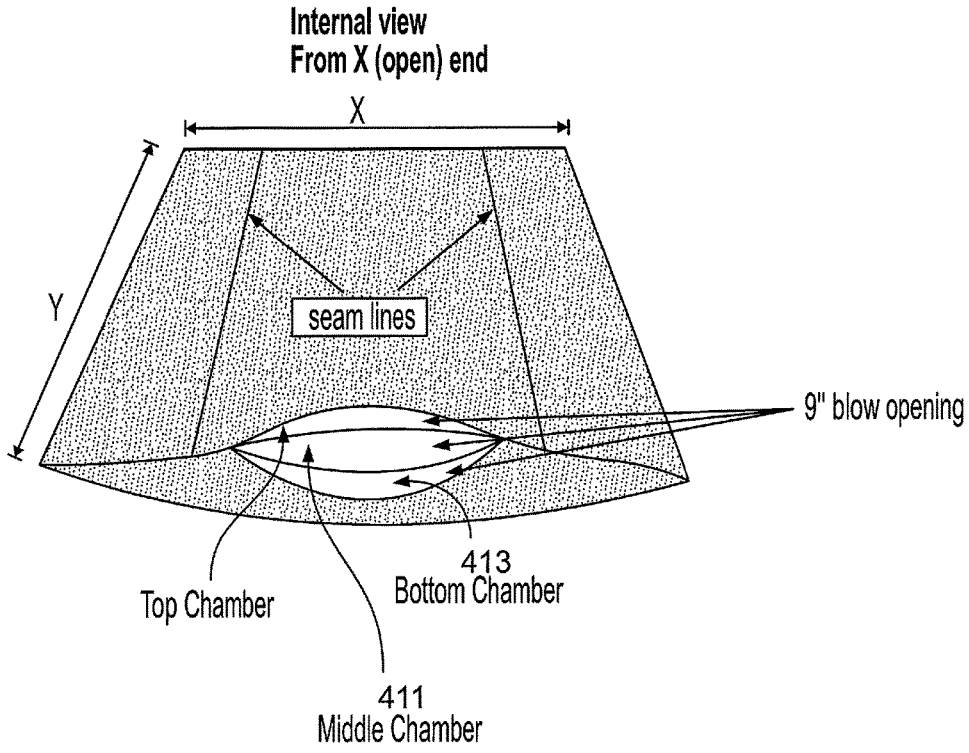
FIG. 4B is a schematic illustration of an internal view of a non-gusset pillow according to a fourth embodiment of the present invention.
Figure 4C:
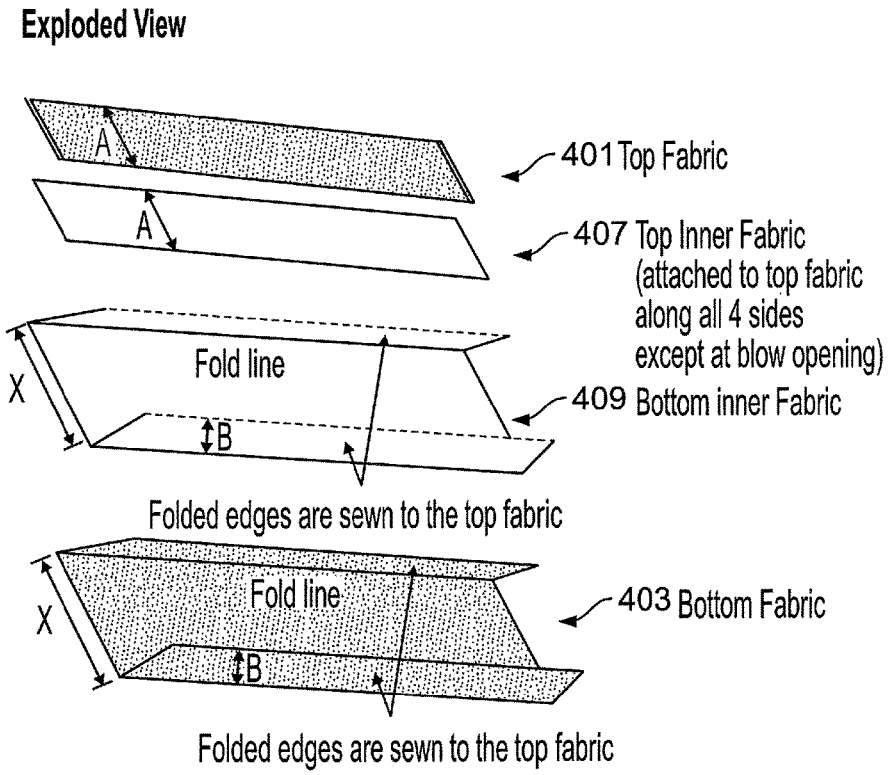
FIG. 4C is a schematic illustration of an exploded view of a non-gusset pillow according to a fourth embodiment of the present invention.

FIGS. 4A-4C schematically illustrate a non-gusset pillow in accordance with a fourth embodiment of the present invention. FIG. 4A shows the top view; FIG. 4B shows an internal view; and FIG. 4C shows an exploded view.

The pillow in accordance with the fourth embodiment of the present invention includes two inner fabrics and, along with a top fabric and a bottom fabric, collectively forms three chambers. Moreover, as further described herein, the pillow in accordance with this fourth embodiment has no seams along the Y edges of the pillow. Without seams along the Y edges, the pillow has a curved structure along those edges. Although not technically correct, it can be said that such seamless, curved structure along an edge represents a "curved gusset design." Accordingly, there are no seams along two of the pillow's edges thus allowing the filling material to expand outwardly towards such seamless edges. The rounder edge of the pillow better properly fits the contour of the head and neck and, along with the increased fill at the edges (as compared to a seamed edge), users have an enhanced sleeping experience.

Referring to the top view of FIG. 4A and the internal view of FIG. 4B, the top of the pillow includes a combination of three segments. But only two panels of material are utilized to make such three segments, such two panels being the panels identified as "Top fabric" 401 and "Bottom fabric" 403 shown in FIG. 4C, as further described below.

Referring particularly to the exploded view shown in FIG. 4C, the two shaded panels, that is, the top fabric and the bottom fabric, collectively form, when sewn together, the outer portions of the pillow. The top fabric, which has a width "A", corresponds to the middle part 405 of the top of the pillow shown in FIG. 4A. As shown in FIG. 4A, as well as FIG. 4B, the top fabric 401 does not extend along the entire width of the pillow (i.e., from top to bottom of the illustration shown in FIG. 4A, wherein the width is shown as "X"). The bottom fabric 403, as shown in FIG. 4C, has two folds and has a width equal to the sum of "X" plus two times "B", wherein the dimensions X and B are shown in FIG. 4A. During construction, the larger, middle portion of the bottom fabric (having a width X, where X=B+A+B) forms the bottom of the pillow, and the two smaller portions (each having a width B) become part of the top of the pillow, with the top fabric disposed between those two smaller portions.

In addition to the top fabric 401 and bottom fabric 403 shown in FIG. 4C, the pillow of the fourth embodiment further includes two additional panels, a top inner fabric panel 407 (top inner fabric) and a bottom inner fabric panel 409 (bottom inner fabric). The top inner fabric panel (or, simply, the "top inner fabric") has a width A, which is the same width as the top fabric panel. During construction of the pillow, the edges of the top inner fabric are sewn to the edges of the top fabric which, in turn, forms the top chamber of the pillow, which is identified in FIG. 4B.

The bottom inner fabric panel 409 (or, simply, the "bottom inner fabric") has the construction shown in FIG. 4C, which is the same construction of the bottom fabric 403. Like the bottom fabric 403, the bottom inner fabric 409 has a width that is equal to the sum of dimension X, plus two times dimension B (see X and B in FIG. 4A). The bottom inner fabric 409 is folded in the same manner as the bottom fabric 403, as shown in FIG. 4C, and the edges of the bottom inner fabric 409 are sewn (or otherwise coupled) to the edges of the top fabric 401. In such configuration, the top inner fabric 407 is disposed between the top fabric 401 and the bottom inner fabric 409, and the bottom inner fabric 409 is disposed between the top inner fabric 407 and the bottom fabric 403. A middle chamber 41 (shown in FIG. 4B) is formed between the top inner fabric 407 and bottom inner fabric 409, as shown in FIG. 4C. Moreover, a lower (or bottom) chamber 413 (shown in FIG. 4B) is formed between the bottom inner fabric 409 and the bottom fabric 403.

Therefore, give the herein-provided description and the illustrations shown in FIGS. 4A-4C, it is seen that the bottom fabric 403 extends along the entire width (and length) of the bottom of the pillow and also extends partially along both sides of the top of the pillow. That is, the two sections of the top of the pillow shown in FIG. 4A that have a width "B" are part of the bottom fabric. Accordingly, with the edges of all four panels shown in FIG. 4C sewn together in the manner described, there is no seam on the "Y" edges of the pillow (FIG. 4A). It is appreciated that all of the panels may be sewn together in a single instance or in multiple steps.

An exemplary pillow in accordance with the herein described fourth embodiment of the present invention may include top and bottom fabrics (representing the outer surfaces of the pillow) made of 330 tc, 100% Cotton, Twill, SPI 173×156/60×60, and inner fabric (i.e., both the top inner fabric and bottom inner fabric) of 230 tc, 100% polyester, 1×1 plainweave, 144×86/65 D×65 D. Exemplary dimensions of the pillow have the follow dimensions: A=12"; B=4"; X=20"; and Y=26". Other appropriate dimensions, as well as materials, may be employed.

Figure 4D:
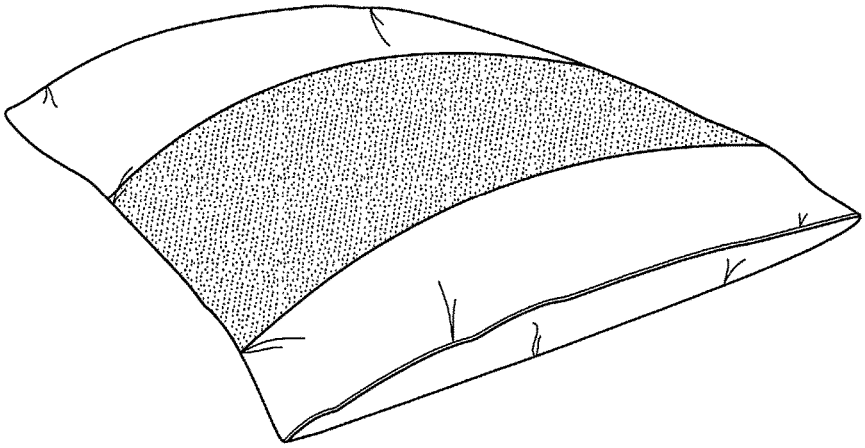
FIGS. 4D and 4E are photographs of two sides of a non-gusset pillow according to a fourth embodiment of the present invention.
Figure 4E:
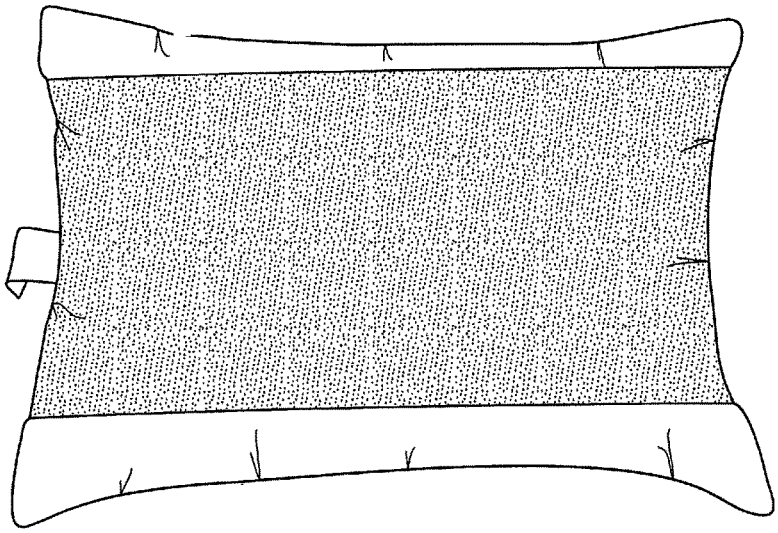

FIGS. 4D and 4E are photographs of the two sides of an exemplary pillow in accordance with the fourth embodiment of the present invention.

Figure 5B:
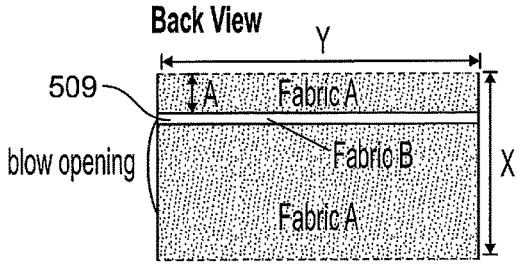
FIG. 5B is a schematic illustration of a back view of a non-gusset pillow according to a fifth embodiment of the present invention.
Figure 5A:
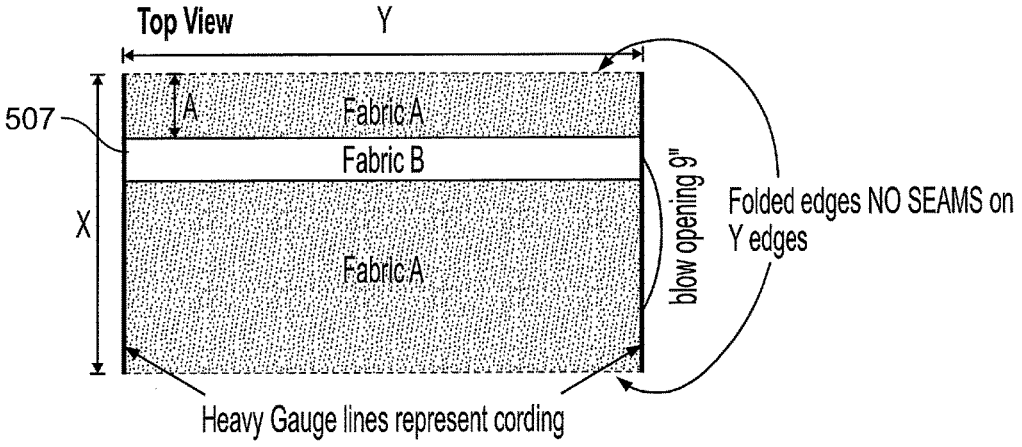
FIG. 5A is a schematic illustration of a top view of a non-gusset pillow according to a fifth embodiment of the present invention.
Figure 5C:
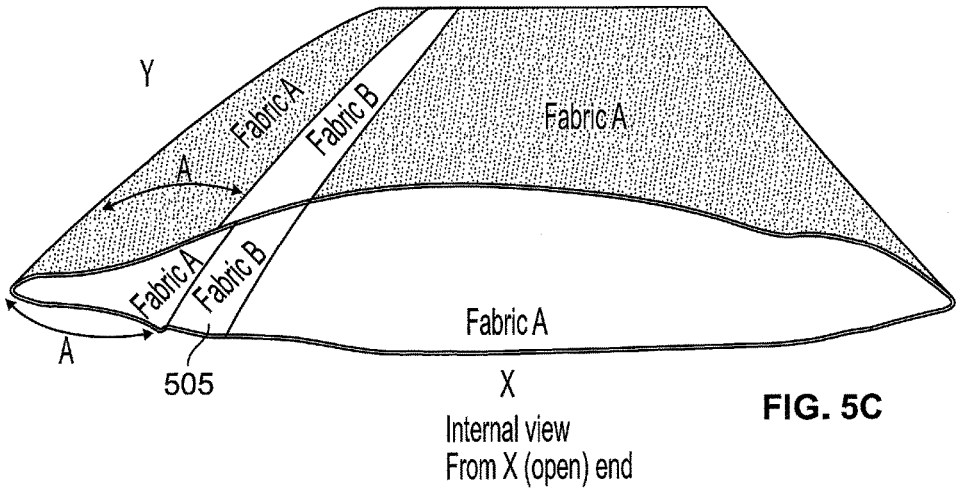
FIG. 5C is a schematic illustration of an internal view of a non-gusset pillow according to a fifth embodiment of the present invention.
Figure 5D:
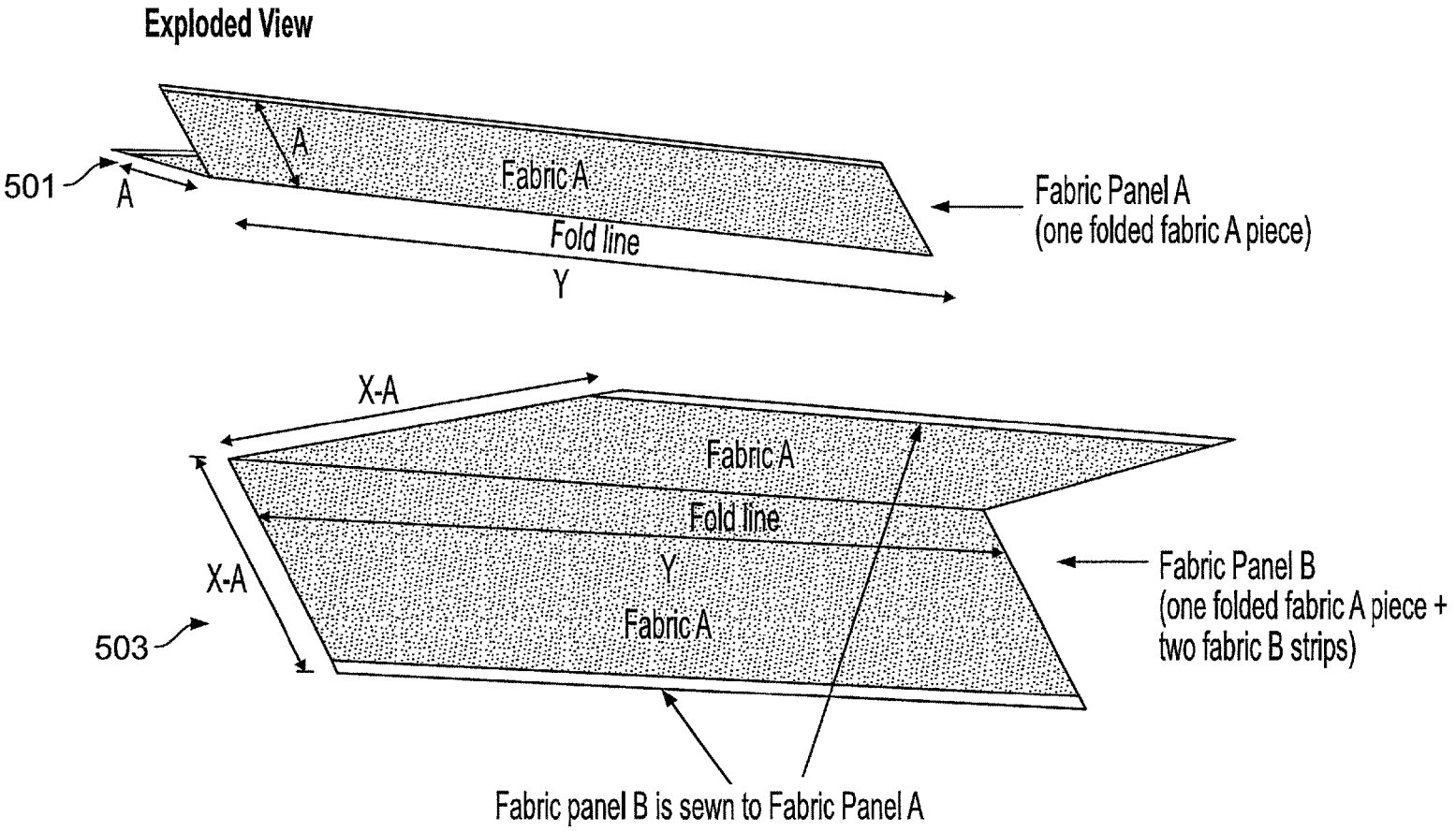
FIG. 5D is a schematic illustration of an exploded view of a non-gusset pillow according to a fifth embodiment of the present invention.

FIGS. 5A-5D schematically illustrate a non-gusset pillow in accordance with a fifth embodiment of the present invention. FIG. 5A shows the top view; FIG. 5B shows the back view; FIG. 5C shows an internal view; and FIG. 5D shows an exploded view.

The pillow in accordance with the fifth embodiment of the present invention includes four panels, two panels of fabric A (a first longer fabric panel and a second longer fabric panel) and two panels of fabric B (a first shorter fabric panel and a second shorter fabric panel). All four panels are disposed on the exterior of the pillow, that is, there are no internal panels in the fifth embodiment. The two panels of fabric A are shown in the exploded view of FIG. 5D. The shorter fabric A panel 501 has a length of 2×A and appears on the left side of the pillow schematically shown in FIG. 5C, and, as shown, has a fold line "Y". The longer fabric A panel 503 has a length of 2×(X−A) as shown in FIG. 5D, has a fold line "Y", and is shown on the right side in FIG. 5C.

The two fabric B panels have the same dimensions and are sewn to, and extend between, the fabric A panels as shown in FIG. 5C. Specifically, one fabric B panel 507 is sewn between the two fabric A panels and appears on the top surface of the pillow, as shown in FIG. 5A. The other fabric B panel 509, similarly, is sewn between the other ends of the two fabric A panels and appears on the bottom surface of the pillow, as shown in FIG. 5B.

An exemplary pillow in accordance with the fifth embodiment of the present invention has both fabric A panels comprised of 330 tc, 100% Cotton, Twill, SPI 173×156/60×60, and both fabric B panels that are 4-way stretch polyester (87% polyester/13% Spandex, 282 g/yard). Exemplary dimensions of such a pillow are: A=5", B=1" (the width of each B panel), X=20", and Y=26". In such exemplary pillow, each B panel is disposed 5 inches from one edge "Y" of the pillow and about 14 inches from the other edge of the pillow. Other materials and dimensions may be employed.

Accordingly, the pillow in accordance with the fifth embodiment of the present invention provides a pillow shell with no seams on the Y edges, and with stretch materials (provided as the B panels), which provides a stretch comfort to users, with an adaptive fit.

Figure 6A:
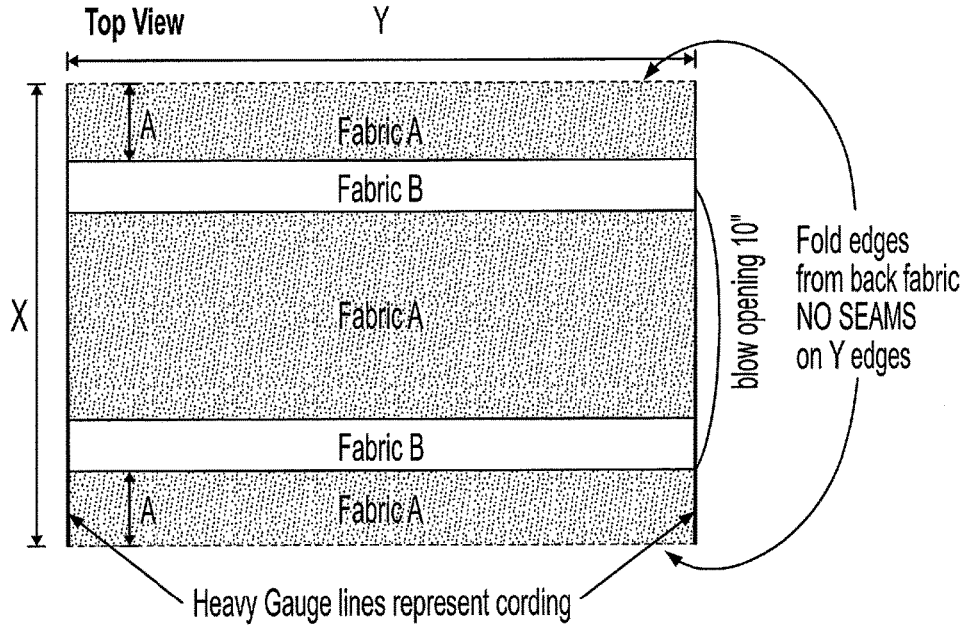
FIG. 6A is a schematic illustration of a top view of a non-gusset pillow according to a sixth embodiment of the present invention.
Figure 6B:
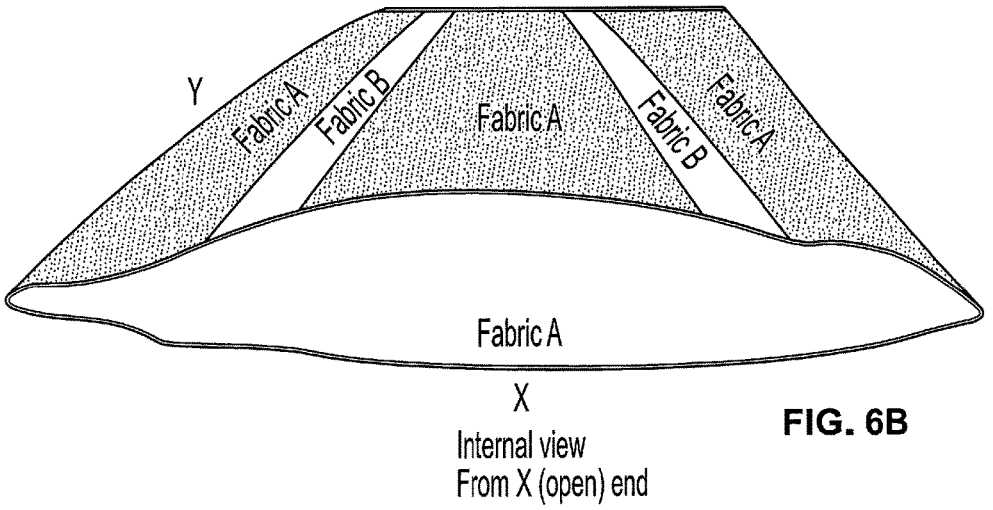
FIG. 6B is a schematic illustration of an internal view of a non-gusset pillow according to a sixth embodiment of the present invention.
Figure 6C:
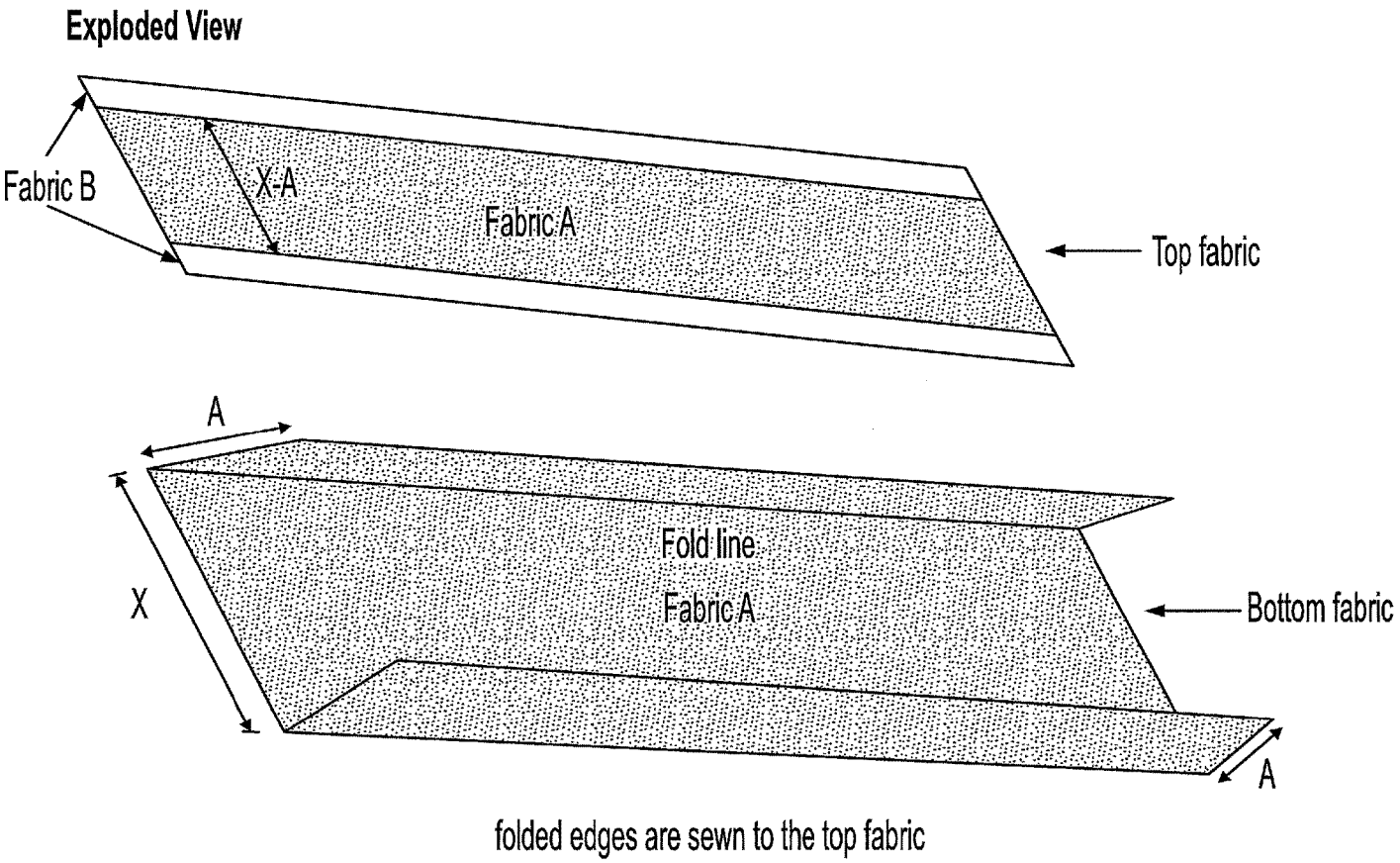
FIG. 6C is a schematic illustration of an exploded view of a non-gusset pillow according to a sixth embodiment of the present invention.

FIGS. 6A-6C schematically illustrate a non-gusset pillow in accordance with a sixth embodiment of the present invention. As shown, FIG. 6A shows the top view; FIG. 6B shows an internal view; and FIG. 6C shows an exploded view.

The sixth embodiment shown in FIGS. 6A-6C is similar to the fifth embodiment, in that the pillow of the sixth embodiment includes four panels, two fabric A panels and two fabric B panels. However, rather than sewing (or otherwise coupling) the two B panels on opposite sides of the pillow, that is, one of the front of the pillow and the other on the back pillow, both fabric B panels are disposed on only one surface (e.g., the top surface) of the pillow, as shown in FIGS. 6A and 6B. Accordingly, the sixth embodiment provides a pillow shell with one sided dual fabric strips and no seams on the Y edges of the pillow.

Other variations and exemplary dimensions and materials described with reference to the fifth embodiment of the present invention also are applicable to the sixth embodiment.

Figure 7A:
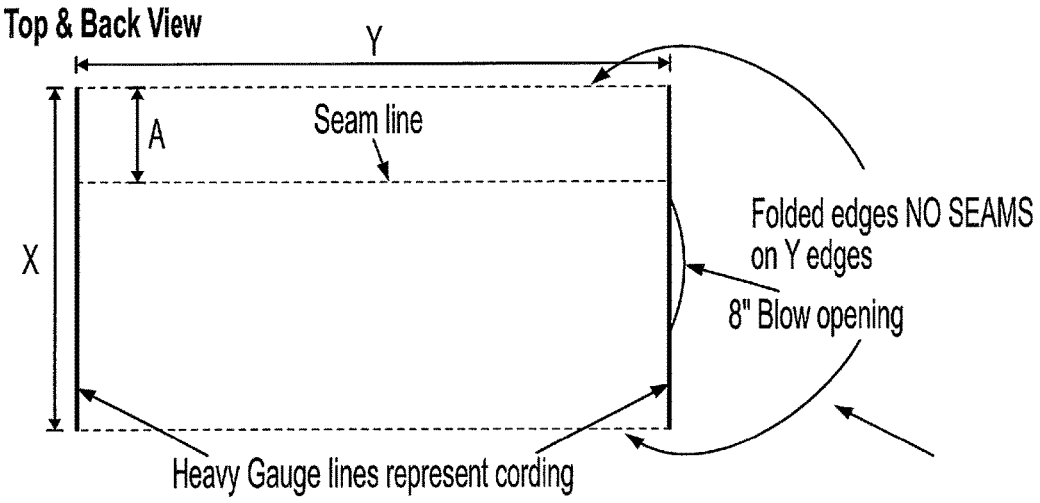
FIG. 7A is a schematic illustration of a top view of a non-gusset pillow according to a seventh embodiment of the present invention.
Figure 7B:
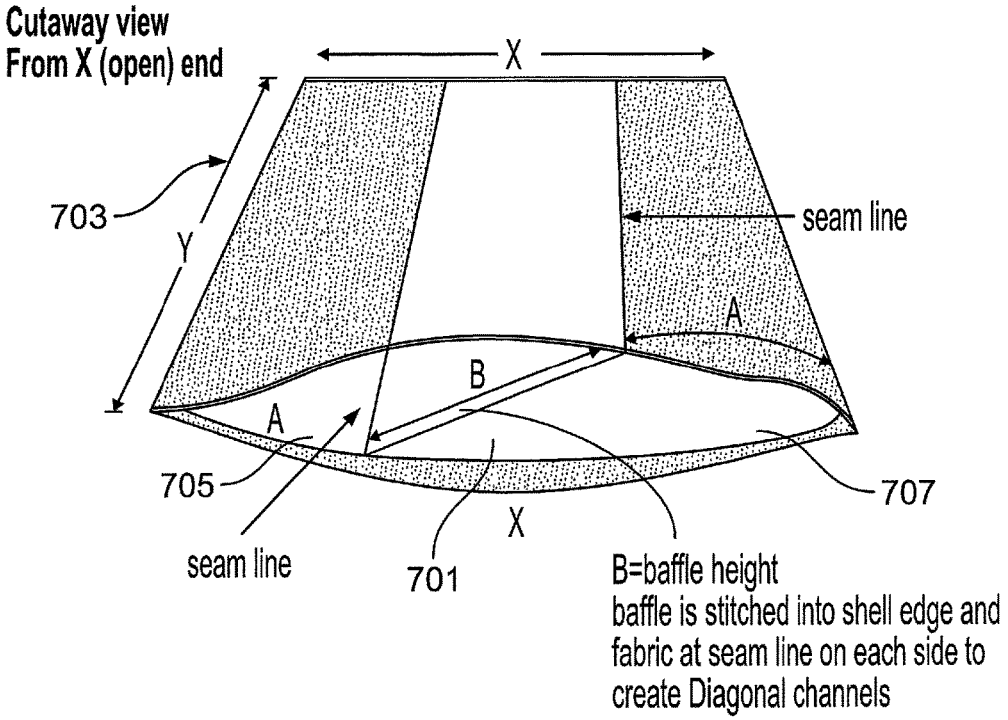
FIG. 7B is a schematic illustration of an internal view of a non-gusset pillow according to a seventh embodiment of the present invention.
Figure 7C:
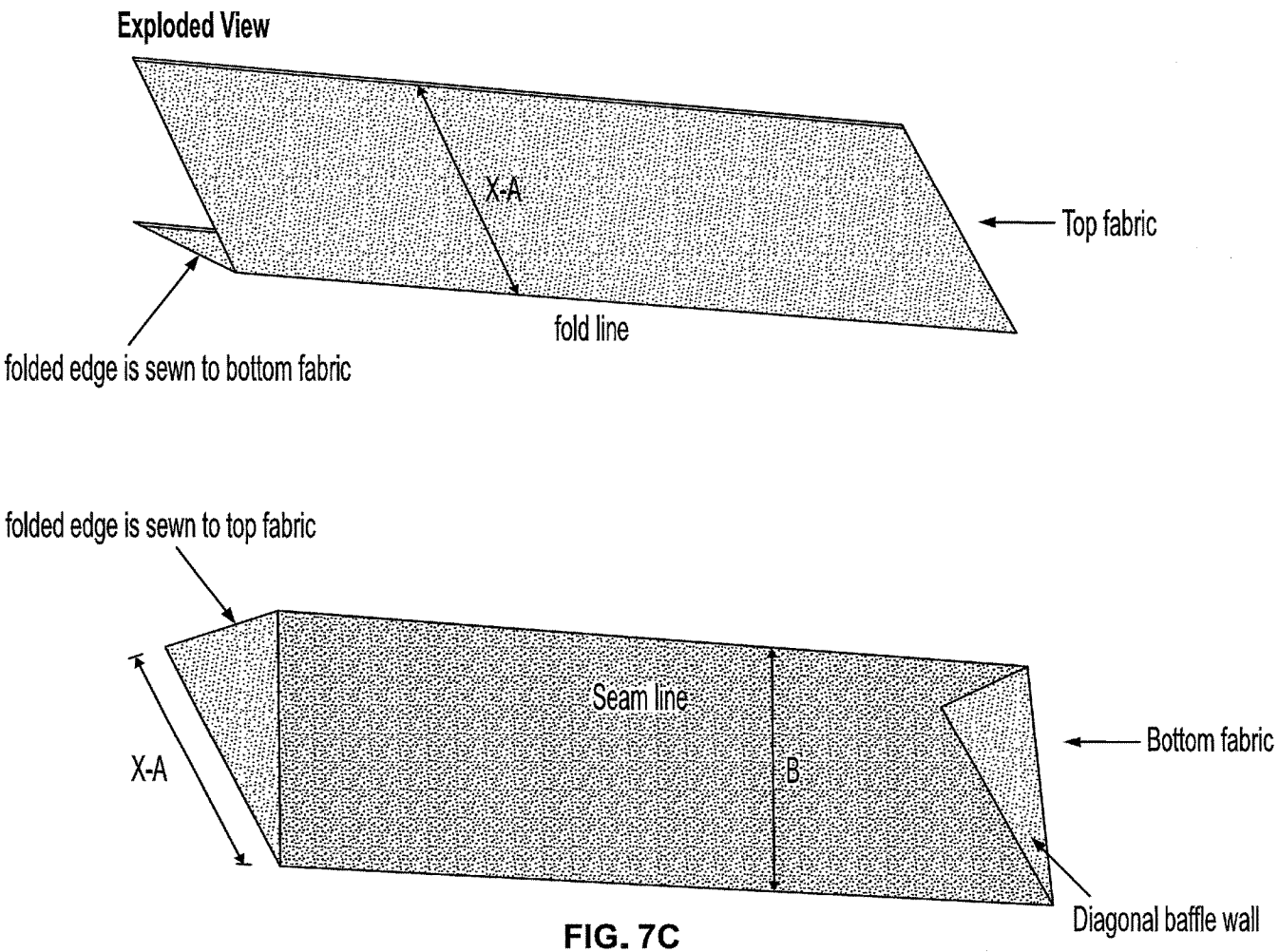
FIG. 7C is a schematic illustration of an exploded view of a non-gusset pillow according to a seventh embodiment of the present invention.

FIGS. 7A-7C schematically illustrate a non-gusset pillow in accordance with a seventh embodiment of the present invention. FIG. 7A shows the top view; FIG. 7B shows an internal view; and FIG. 7C shows an exploded view.

The pillow of the seventh embodiment, as shown, has two chambers and a diagonal baffle wall, and also has no seams on the Y edges of the pillow.

In the seventh embodiment, the pillow includes two outer fabric panels and an inner fabric panel 701, which operates as a baffle 701. The construction of the two outer fabric panels is shown in FIG. 7C. As shown in FIG. 7B, the two outer fabric panels have the same dimensions, and both have the same fold line, which form no seam on each of the Y edges 703 of the pillow, and collectively form the pillow's outer casing. As shown in FIG. 7B, one end of the baffle 701 (or inner panel) is sewn to the edges of both outer panels and, likewise, the other end of the baffle is sewn to the other edges of both outer panels. With such construction, two chambers within the pillow are formed, a first chamber 705 and a second chamber 707. The size and dimension of each chamber 705 and 707 are the same, with the baffle extending within the interior of the pillow diagonally from the top of the pillow to the bottom of the pillow. Accordingly, each chamber has a diagonal surface as defined by the diagonally disposed baffle 701.

An exemplary pillow in accordance with the seventh embodiment of the present invention has both outer panels comprised of 330 tc, 100% Cotton, Twill, SPI 173×156/60×60, and the inner baffle comprised of 4-way stretch polyester (87% polyester/13% Spandex, 282 g/yard). Exemplary dimensions are A=6", B=8", X=20" and Y=26". Of course, other sizes and materials may be employed.

Figure 7D:
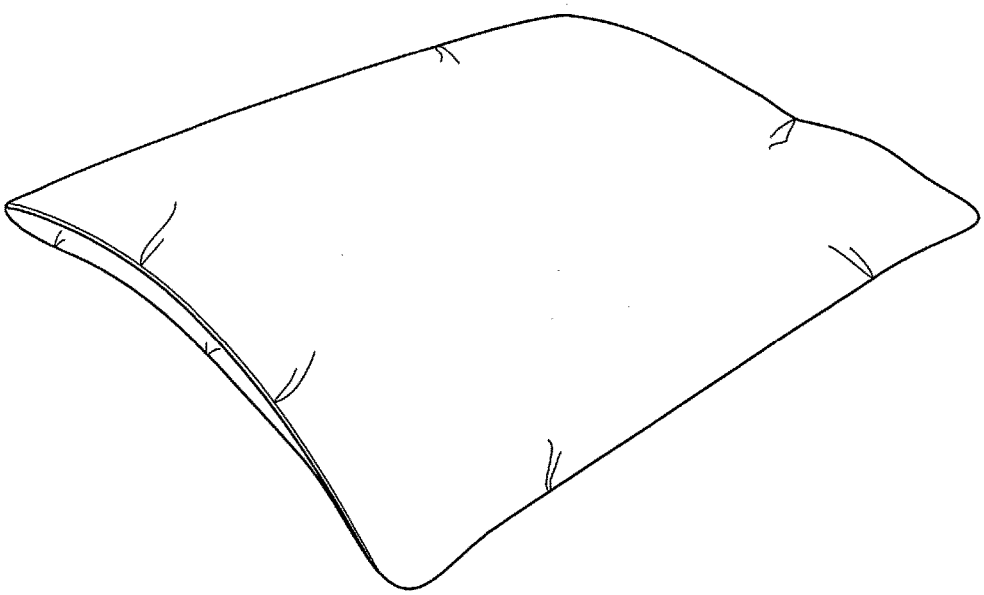
FIG. 7D is a photograph of a non-gusset pillow according to a seventh embodiment of the present invention.

FIG. 7D is a photograph of an exemplary pillow in accordance with the seventh embodiment of the present invention.

Figure 8A:
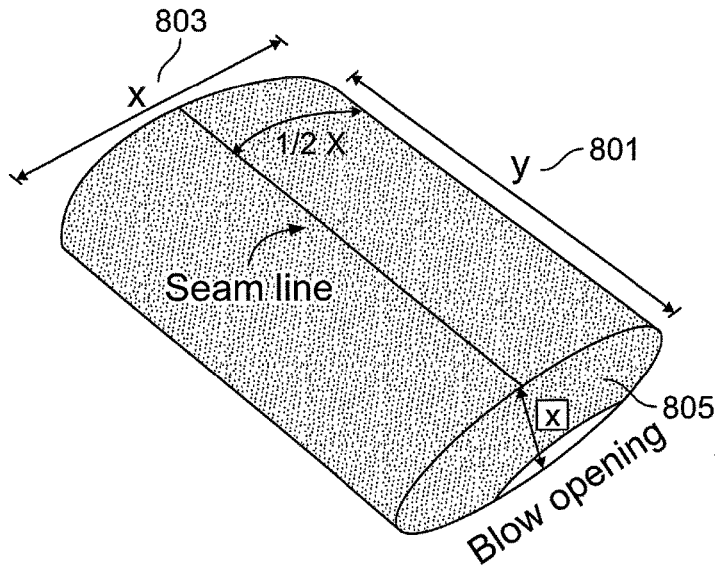
FIG. 8A is a schematic illustration of a perspective view of a non-gusset pillow according to an eighth embodiment of the present invention.
Figure 8B:
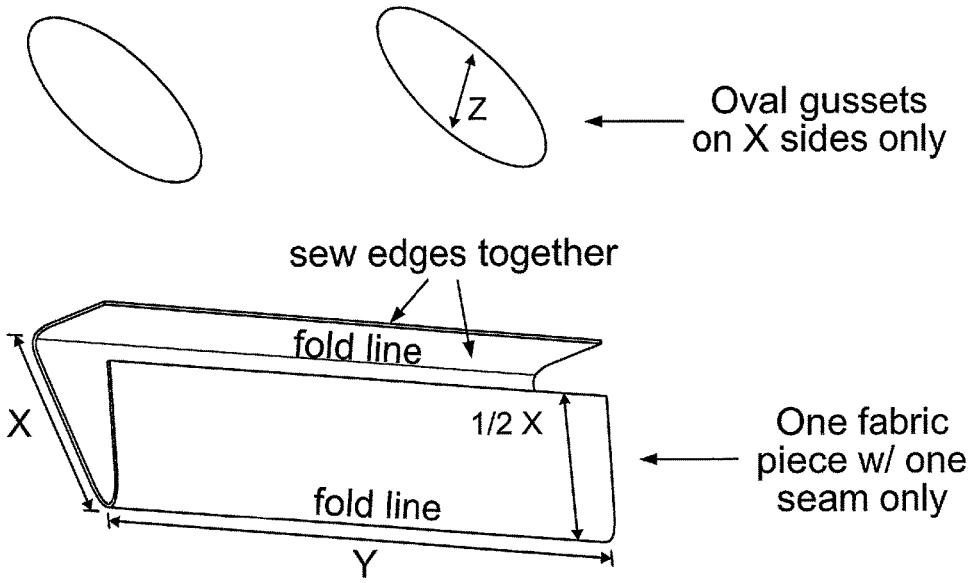
FIG. 8B is a schematic illustration of an exploded view of a non-gusset pillow according to an eighth embodiment of the present invention.

FIGS. 8A-8B schematically illustrate a partial, non-gusset pillow in accordance with an eighth embodiment of the present invention. FIG. 8A shows a perspective view and FIG. 8B shows an exploded view.

The pillow of the eighth embodiment is a single chamber pillow with no seams on the Y edges 801 of the pillow, but includes oval shaped gussets only on the X sides 803 of the pillow.

Figure 8C:
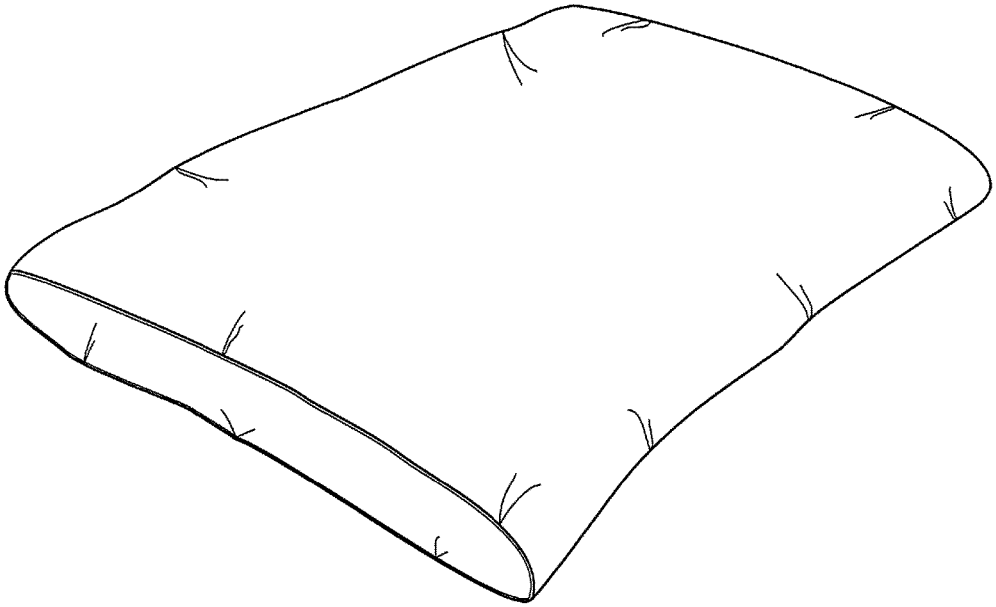
FIG. 8C is a photograph of a non-gusset pillow according to an eighth embodiment of the present invention.

In the eighth embodiment, the pillow includes a single fabric panel for the top and bottom surfaces of the pillow, with only a single seam, in which the panel includes two fold lines across the Y edges of the pillow, as shown in FIGS. 8A and 8B. In addition, the pillow includes a pair of X-side oval gussets 805. FIG. 8C is a photograph of an exemplary pillow in accordance with the eighth embodiment of the present invention.

In a variation of the eighth embodiment, the pillow does not include the oval gussets, in which the top and bottom portions of the single fabric panel are sewn together along the X edges of the pillow.

Figure 9:
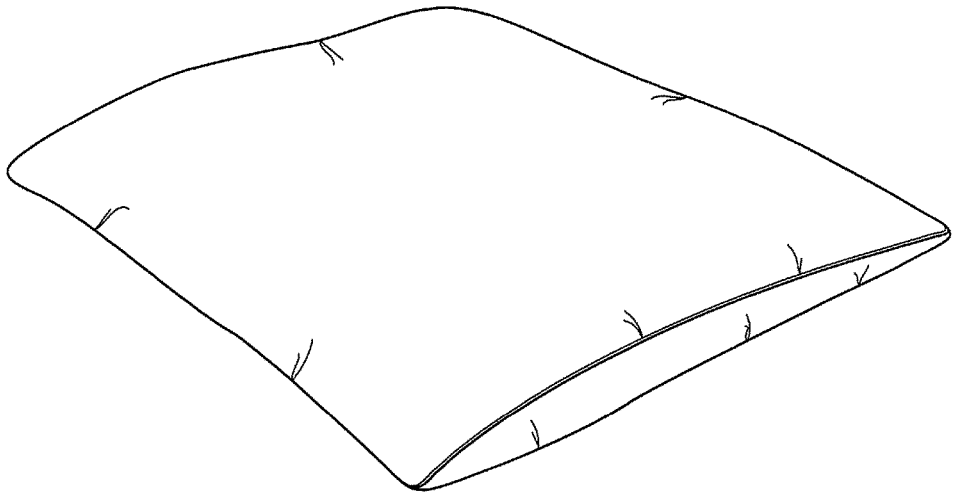
FIG. 9 is a photograph of a pillow according to an embodiment of the present invention.

FIG. 9 shows a photograph of a pillow according to an embodiment of the present invention and FIG. 10 is a photograph of the top fabric of a pillow, according to an embodiment of the present invention.

In each of the embodiments of the invention described herein, and all variations thereof, the various described pillows of the invention may be manufactured, using the constructions and features described, in manners well known in the art. In particular, the manner in which the fabric panels are sewn together may be achieved in various ways and, thus, the inventions described herein are not limited to any particular manner of connection. In addition, upon such connection/assembly of the various panels/components, as discussed herein, the single chamber or multiple chambers of the pillows, as the case may be, are filled in any manner known in the art or in future-devised manners. For example, some of the figures show blow openings, but such blow openings are merely illustrative of particular manners of complete manufacture of the pillows. Moreover, the particular filling material may be any appropriate type of fill, such as Lyocell Down, partial Lyocell/Poly blend, to name just a few.

Still further, the various embodiments have been described as including multiple fabric panels, but the particular type of material used for the panels may be different than the examples disclosed herein and, further, may be made of material that some may deem to not represent fabric, such as leather. Accordingly, the terms "fabric" or "fabric panel" are used for convenience to refer to a panel of material that have the shape and size of that shown in the various embodiments described herein.

In select embodiments of the present invention, the pillows advantageously have constructions that cause the fill to move to the edge of the pillow. In particular, in those embodiments and variations in which some of the edges of the pillow do not have seams, but rather are formed by employing the herein-described and shown fold lines, such embodiments and variations result in pillows in which the filling material within the one or multiple chambers move outward towards such edges that do not have seams, which in turn provides additional neck support to users than otherwise would be the case. In addition, the seamless edges result in a curved (or rounded) structure along those edges, such as shown in FIG. 9, and such rounded edge provides properly fits the contour of the head and neck, which in turn results in an enhanced sleeping experience for user.

Although embodiments of the present invention have been described in detail hereinabove, it should be clearly understood that many variations and modifications of the basic inventive concepts herein taught which may appear to those skilled in the present art will still fall within the spirit and scope of the present invention, as defined in the appended claims and their equivalents.

What is claimed is:

1. A pillow, comprising:

a first panel coupled to a second panel along first and second seam lines: and a baffle fixedly attached to the first panel and the second panel forming a first chamber and a separate second chamber, the first chamber filled with a first fill, the second chamber filled with a second fill, and the baffle extending within the interior of the pillow diagonally from the first panel to the second panel, wherein the baffle is fixedly attached to the first and second seam lines between the first panel and the second panel.

2. The pillow of claim 1, wherein a width of the baffle is 8".

3. The pillow of claim 1, wherein a distance between a first length-wise edge of the baffle and a first length-wise edge of the pillow is equal to a length between a second length-wise edge of the baffle and a second length-wise edge of the pillow.

4. The pillow of claim 1, wherein the baffle comprises a material different from a material of the first and second panels.

5. The pillow of claim 4, wherein the baffle comprises four-way stretch polyester material.

6. The pillow of claim 1, wherein the baffle is fixedly attached to the first and second seam lines along peripheral edges of the baffle by stitches.

* * * * *